United States Patent [19]

Mancini

[11] Patent Number: 4,704,844

[45] Date of Patent: Nov. 10, 1987

[54] PACKAGING MACHINE

[76] Inventor: Derek Mancini, 21 Progress Avenue, Unit 2, Scarborough, Ont., M1P 4S8, Canada

[21] Appl. No.: 886,726

[22] Filed: Jul. 18, 1986

[51] Int. Cl.[4] ..... B65B 47/02; B65B 47/04; B65B 43/08

[52] U.S. Cl. ..... 53/453; 53/559; 53/468; 53/381 R

[58] Field of Search ..... 53/453, 454, 559, 560, 53/574, 468, 477, 381 R

[56] References Cited

U.S. PATENT DOCUMENTS

| | | | |
|---|---|---|---|
| 2,796,033 | 6/1957 | Feinstein | 53/453 X |
| 2,991,500 | 7/1961 | Hagen | 53/454 X |
| 3,039,246 | 6/1962 | David | 53/453 |
| 3,092,940 | 6/1963 | David | 53/453 |
| 3,245,197 | 4/1966 | Van Mil, Jr. et al. | 53/453 |
| 3,354,611 | 11/1967 | Powell | 53/559 |
| 3,533,215 | 10/1967 | Ollier | 53/559 |
| 3,782,066 | 1/1974 | Schmitt | 53/453 X |

FOREIGN PATENT DOCUMENTS

| | | | |
|---|---|---|---|
| 1444527 | 5/1966 | France | 53/453 |

*Primary Examiner*—Horace M. Culver

[57] ABSTRACT

A method and apparatus for forming, filling and sealing small liquid type containers is disclosed which is based on the forming and sealing of opposed container halves made from strip material. The apparatus and method take flat strip material and suitably form, shape and seal the strip material resulting in containers which are further processed to fill and seal the containers. Such a method and apparatus reduces the unit cost for packaging such products as cream in individual portion containers.

20 Claims, 8 Drawing Figures

FIG.1.
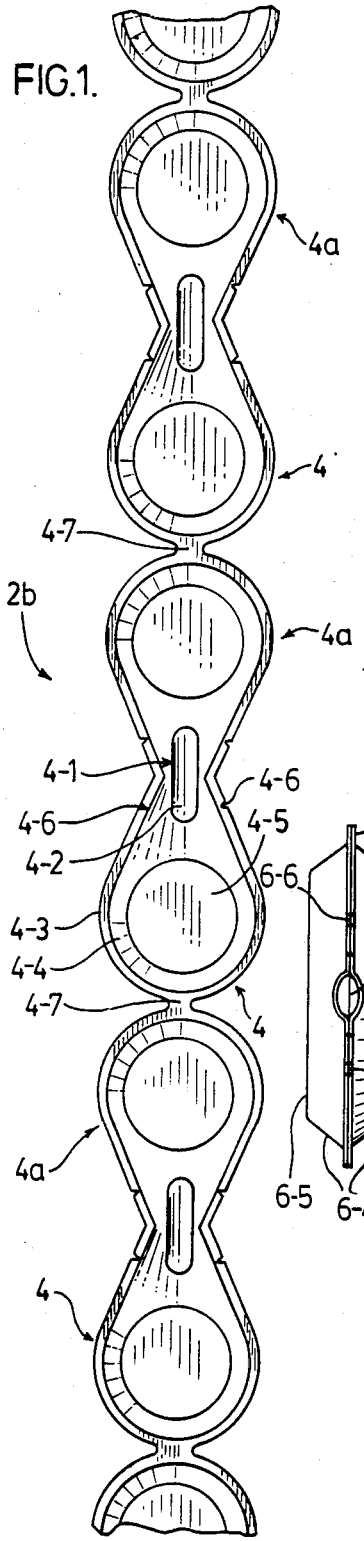
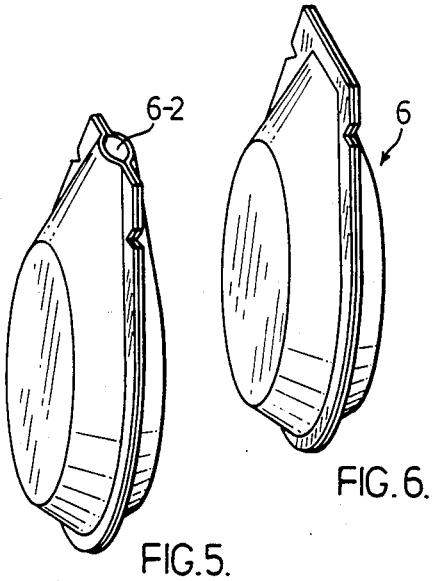
FIG.5.
FIG.6.
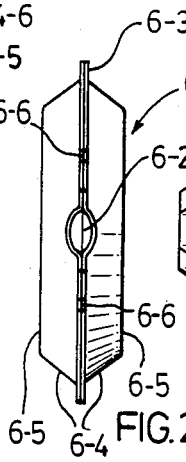
FIG.2.
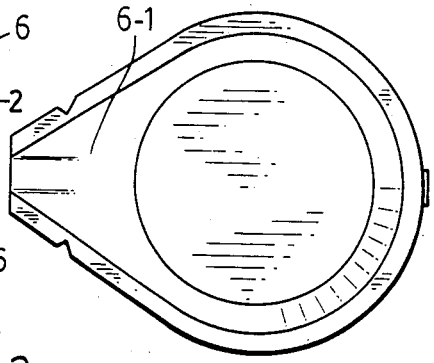
FIG.3.
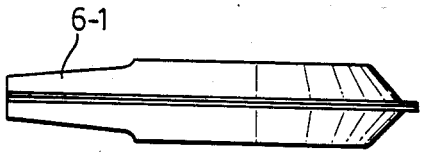
FIG.4.

PACKAGING MACHINE

BACKGROUND OF THE INVENTION

The present invention relates to apparatus for the packaging of food products in individual containers. The invention particularly relates to an apparatus and method adapted to form, fill and seal a plastic container. This method and apparatus has particular application for the forming and filling and sealing of small containers such as creamers and/or condiments where the container is sized for a single serving.

Apparatus for forming, filling and sealing of creamers are known and have a number of advantages over the pre-forming of small creamer containers for example, and subsequently using these formed containers in a filling and sealing machine. The container forming operation suitable for the forming of plastic containers is normally accomplished by heating of a flat substrate in preparation for an extruding step. This heating operation acts to a certain extent to disinfect or sterlize what will become the interior of the container. Form fill seal machines also have advantages in that the supply stock, namely flat plastic disks or sheeting or strip material of plastic or foil paper laminate are easily stored. The main advantage with a form fill and seal machine is the reduced cost as the container is formed in the filling apparatus and is made from relatively low cost forming material which may or may not be pre-cut by a diecutting operation. In most cases, the diecutting which determines the initial configuration of the blank or forming material is pre-printed.

The packaging of creamers has been generally confined to small frusto conical containers which have a flat lid heat sealed thereto. The volume of the container is quite small and the normal practice is to fill the container with about 5/8 of an ounce of product. Numerous approaches have been taken with respect to filling of these containers, as generally determines the maximum product output. As can be appreciated, the containers are normally moved along a predetermined path past a filling operation and subsequently advanced through a heat sealing operation. In some cases, the apparatus will have a generally fixed location filling and sealing station for use in combination with a intermittent movement conveyor or in some other cases, the containers are continuously advanced and the filling and sealing operation is carried out as the container is advanced. In designing machines of either type described above, problems occur as the rate of filling and sealing of the containers is quite critical and this generally necessitates the containers to be moved quite quickly. The containers are relatively shallow, and product splash can contaminate the generally flat flange area at the top of the containers used for heat sealing with the lid material.

According to the present invention, a form, fill and seal apparatus and method are possible, suitable for the packaging of cream as well as other liquid like products, which could include condiments. The apparatus and method allow the forming, filling and sealing of a container made from a previously diecut formable strip material such as plastic or foil allowing the unit cost to the dairy for filling of a container to be substantially reduced.

SUMMARY OF THE INVENTION

According to the present invention, a method for forming, filling and sealing of a container is possible where the container is made from opposed strip material where strip has been deformed to form a portion of a container. Two strips of formable material are advanced separately through forming and shaping operations resulting in two series of half containers, each having a recess therein generally surrounded by a similarly sized flange. The formed strips are then aligned in opposed relationship with the flanges of the half containers in opposed abutting relationship. This results in a central cavity between the opposed half containers which will eventually receive and retain the product. The opposed flanges are then secured about a substantial portion thereof to form a container having a liquid-tight seal between the opposed flanges while leaving an unsealed area for filling of the container. This partially sealed container is then advanced through a filling operation where product is introduced into the cavity through the unsealed area with the filled container subsequently advanced to a sealing operation for sealing of the remaining portion of the opposed flanges, thereby closing the control cavity. The formed containers may then be cut from the series of like half containers or may have been pre-cut prior to the filling operation.

The apparatus generally has two heating and forming stations for separately forming of the opposed series of like half containers with these two formed strips then being brought into aligned opposed relationship in a single conveyor. The aligned container halves are then advanced through a first forming station where the container is formed suitable for the latter filling operation. The formed containers are not from the series of container halves with the resulting product being advanced and preferrably orientated for the filling operation. The filled containers are then sealed.

According to a preferred embodiment of the invention, the method and apparatus use an intermittent movement conveyor which preferrably includes conveyor plates for engaging and securely retaining the formed containers by at least engaging a portion of the opposed flanges of the containers about the periphery thereof.

BRIEF DESCRIPTION OF THE DRAWINGS

Preferred embodiments of the invention are shown in the drawings wherein:

FIG. 1 shows a series of shaped container halves which are still interconnected;

FIG. 2 is a top view of a formed container as it is to be advanced to the filling operation;

FIG. 3 is a top view of a formed container suitable for the filling operation;

FIG. 4 is a side view of the formed container suitable for the filling operation;

FIG. 5 is a perspective view of the formed container suitable for the filling operation; and FIG. 6 shows the filled container after the second heat seal operation;

DETAILED DESCRIPTION OF THE PREFERRED EMBODIMENTS

Figure 7:
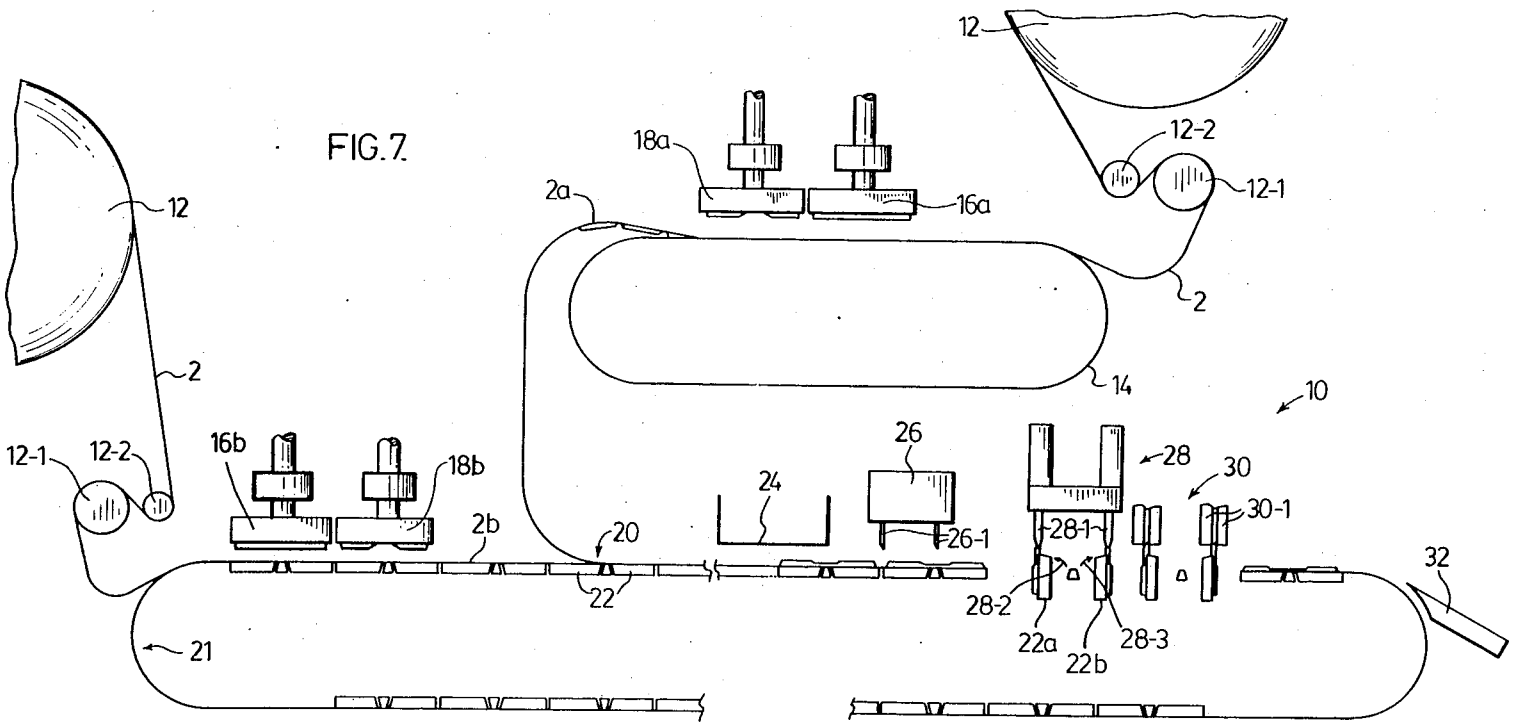
FIG. 7 is a general layout of the form, fill and seal apparatus.

The flat strip material generally shown as 2 in the drawings is passed through a forming station having a heating pad generally shown as 16a or 16b in FIG. 7 and a forming punch 18a or 18b to create the series of interconnected shaped container halves 2b shown in FIG. 1. Each container half 4 or 4a includes a neck area 4-1 which includes a portion 4-2 of a filling tube generally labelled 6-2 in FIG. 2. Each container half also includes a flange area 4-3 tapered side walls 4-4, a base or top portion 4-5 which prsents a flat surface suitable for printing, a notched out area 4-6 for opening of the container and a small joining tab 4-7. The series 2b is made up of container halves 4 and 4a whereby the portion 4-2 of a filling tube of each container half is made at the same time. The formed series of shaped container halves 2b are married with an opposed like strip 2a at position 20 in FIG. 7 with the flanges of the opposed shaped strips in abutting relationship. These are subsequently advanced past the heat sealing station 24 for forming of the container 6 shown in FIG. 2. This formed container is advanced past the filling station 28 of FIG. 7. The container 6 includes the filling tube 6-2 in the neck area 6-1, secured flange areas 6-3 which preferrably have been ultrasonically welded at the sealing station 24 opposed tapered side walls 6-4 and the opposed flat printing or advertising portions 6-5. The notched out areas 4-6 of each container half are now joined and define notched out area 6-6 which will be used by the end consumer in opening of the final sealed container. After the cutting station 26, a small stub 6-7 is left which secured the formed container halves in the series. The container shown in FIGS. 2, 3 and 4 is advanced past the filling station 28 to fill the central cavity of container 6 with product. The filled container is then advanced past the final heat seal station 30, where the neck portion 6-1 is clamped and heated to collapse the filling tube 6-2 and result in the final sealed product generally shown in FIG. 6.

The formed container suitable for filling as shown in FIG. 5 is substantially closed and only has a top opening defined by filling tube 6-2 for introducing product into the container. As can be appreciated. This structure greatly reduces the possibility of product splash as it is moved to the heat seal station 30, as the opening is small and is generally shaped as a tube. This is in contrast to the wide opening of normal frusto conical creamer containers where slop and slippage can be a problem, particularly where the containers are moved quickly and intermittently.

In FIG. 7, two separate supplies generally indicated as 12 of flat strip formable material 2, are each separately advanced past a heating and forming station. The first heating and forming station is indicated as a heating pad 16a and forming punch 18a with the pad 16a and the forming punch 18a heating the area of the strip and contacting the area of the strip to form container halves 4 and 4a. This results in a first formed series of container halves 2a and a second series of formed container halves 2b which are married in the conveyor plates 22 at position 20. The married strips are then advanced past the heat sealing station 24 where the opposed flange area 4-3 of like container halves are sealed to form a liquid tight seal, preferrably by ultrasonic welding of the opposed plastic flange areas. The exact heat seal operation may vary depending upon the material of the strips 2.

The cutting station 26 includes two knives 26-1, one for cutting the neck area 6-1 between opposed containers 6 and for cutting the joining tab 6-7 between adjacent containers of the strip. At the filling station 28, the separated containers are rotated approximately 90° to allow filling through the filling tube 6-2 of each container. Conveyor plate 22a is rotated counter-clock wise 90° whereas conveyor plate 22b is rotated clock-wise 90°. This opposite rotation is a function of the particular orientation of the series of shaped half containers and if a different orientation was used, the conveyor plates could rotate in the same direction. Rotation of the containers the full 90 degrees is not required as a rotation of about 30° is satisfactory in most cases. The containers located within conveyor plate 22a and 22b are held in the conveyor plate by snap fit of the flange of each container with the conveyor plate. An undercut area is provided for receiving the flange of the container such that the container is engaged about the periphery thereof and held in the conveyor plate. Details of this can be appreciated from the conveyor plate of FIG. 8.

With the apparatus of FIG. 7, the conveyor 21 having conveyor plates 22 is driven intermittently and is advanced a distance corresponding to the width of two conveyor plates 22. This allows the forming of two container halves as well as the filling of two containers for each movement of the conveyor, thereby allowing the output of the conveyor to be fairly high. Normally the filling operation is the operation which determines the maximum output rate of the device and, therefore, two filling tubes have been used 28-1 for filling two containers simultaneously. Although the filling step may be the time limiting one, the forming step which requires a heating of the strip prior to the forming also requires a substantial amount of time, which has been reduced to the heating of two and the forming of two container halves at the same time.

Conveyor 14 would also include conveyor plates and would be driven in timed sequence with the conveyor 21. In order to assure an orderly advance of the strips 2, each supply roll 12 includes a drum unwinder 12-1 and guide roller 12-2. The drum unwinder 12-1 is driven in accordance with the speed of the forming, filling, sealing apparatus 10.

At station 30, two neck seal devices are shown, each having opposed heating plates 30-1 for initially clamping of the filling tube and flange in the area of the neck area 6-1 which collapse the filling tube and provide a seal thereacross. Therefore, the plates 31 apply pressure to collapse the filling tube and also apply energy to the neck area for sealing thereof. This seal may be accomplished by ultrasonic welding for example.

The conveyor plates are returned to the general horizontal position after the sealing station 30 and the sealed containers are discharged from the conveyor into the discharge shoot 32. The discharge of the container from the conveyor plates 22 is preferrably accomplished by pushing of the containers from the conveyor plate from below.

Figure 8:
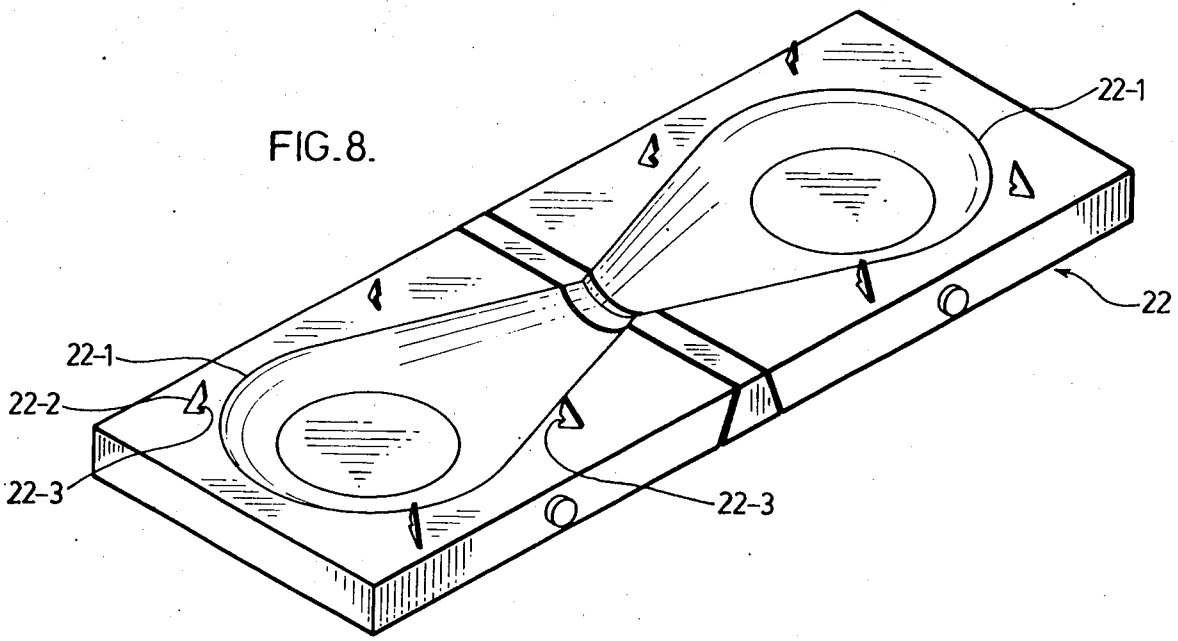
FIG. 8 is a perspective view of a conveyor plate flange engaging lugs for retaining the flange of a formed container.

The form, fill, sealing apparatus shown as 10 in FIG. 7 has been described with respect to the advancement of strips 2 for use in a single lane conveyor, however, in practice the apparatus will be designed on a multi-lane principle, and as such will have a conveyor plate generally as shown in FIG. 8. This multi-lane apparatus allows a fairly high output to be obtained and is a common practice in filling machines. The conveyor plates 22 have a number of product receiving openings 22-1 which correspond with the number of lanes used in the apparatus. Each of these openings include guide means 22-2 for engaging the flange area 6-3 or a portion of the flange area about each container 6 to snuggly retain the container within the conveyor plate 22. In FIG. 8, the guide means are pegs 22-2 having a lower notched out region 22-3 for providing a snap fit with the periphery of the flange 6-3 of a container. It is also possible to provide a recessed opening 22-1 which would include an undercut area therein for providing the snap fit with the container flange.

The apparatus of FIG. 7 allows the form, fill and seal operation to be carried out on two separate strips of formable material which are subsequently brought into opposed aligned relationship for forming of a container. The forming operation is adapted to leave a portion of the container open and an improved filling operation is assured by the preforming of a filling tube. The containers are then advanced and orientated for filling whereafter the filling tube is collapsed and heated to seal the flanges in the neck area of the container. This results in a liquid tight seal about each container. The containers are then bulk packaged through the discharge shoot 32.

The apparatus and method have been particularly described with plastic strip material, however, paper foil laminate material may also be suitable. In this case, heating of the substrate prior to the punching operation is not necessary.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A method of forming a container, filling the formed container and sealing the container comprising;

advancing two strips of formable material through separate forming operations and shaping each strip to form a series of half containers each having a recess therein generally surrounded by a similarly sized flange.

aligning the two strips in opposed relation abutting the flanges of opposed half containers in a manner to form a central cavity for receiving product by having said container halves of each of said strips received in a recessed plate of a horizontal conveyor, securing the opposed flanges substantially about the periphery thereof to form a container having a liquid tight seal between opposed flanges while leaving an unsealed area between opposed flanges for filling of the container, cutting each of the formed containers from the strip material and rotating said plates to appropriately orientate the containers with the unsealed area at a raised position, filling each formed container through the unsealed area, and subsequently sealing the remaining portion of the opposed flanges providing a liquid tight seal thereabout.

2. A method as claimed in claim 1 including forming a filling opening in at least one of the opposed flanges prior to securing the opposed flanges and orientating the formed containers with the filling opening at the top of the container in preparation for filling of the container.

3. A method as claimed in claim 1, wherein cutting of the formed containers is completed prior to the filling of the containers, and the containers after cutting are rotated between 30° to 90° to orientate the container for top filling through said unsealed portion.

4. A method as claimed in claim 2 including forming said filling opening for each cavity at least partially in the portion of the series of half containers intermediate adjacent half containers.

5. A method as claimed in claim 1 including holding the containers in the conveyor by commonly engaging the flanges of opposed container halves at a number of points about the periphery of the flanges and maintaining said engagement as the form containers are orientated for filling.

6. A method of forming, filling and sealing a container made from opposed formable strip material, comprising advancing each strip material through a forming and shaped operation to form a portion of the container and provide a sealing area thereabout for abutment with a like sealing area of the other strip material, aligning each formed strip material in opposed relation to define the container with the sealing areas in abutment, advancing the aligned strip material through a sealing operation to effect a seal between said sealing areas and define a filling inlet through which product is introduced to the container, cutting the containers from the strip material, changing the orientation of the containers to position the filling outlet at an upper position in preparation for filling, advancing the container through a filling station and filling the container through the filling inlet with product and subsequently sealing the filling inlet to close the container.

7. A method as claimed in claim 6, wherein said aligned formed strips are advanced in an intermittent movement conveyor and said sealed containers are cut from the series of strip material prior to filling of the container.

8. A method as claimed in claim 7, wherein containers are rotated 90° degrees to orientate the containers for filling.

9. A method as claimed in claim 7, wherein each strip is formed and shaped in a similiar manner.

10. A method as claimed in claim 7, wherein sealing of the filling inlet includes collapsing the filling inlet and heat sealing the collapsed inlet.

11. A method as claimed in claim 7, wherein all sealing of the container is completed by ultrasonic welding.

12. Apparatus for the form, filling and sealing containers such as individual serving creamers and the like comprising first and second forming and shaping stations, a sealing station, a first conveyor means for advancing a first series of interconnected partially diecut container forming material through said first forming and shaping station to shape the material to form half containers, a second conveyor means for advancing a second series of interconnected partially cut container forming material through said second forming and shaping station to shape the material to form half containers, means for bringing said second series into opposed aligned relation with said first series and in said first conveyor means to be advanced with said shaped first series advancing the first conveyor means to pass the aligned opposed series through said sealing station to secure and form a liquid tight seal between the opposed container halves while leaving a filling inlet, means for cutting the series of forming material to free the partially sealed container therefrom, means for orientating the partially sealed container to position the filling inlet for top filling of the container, a filling station for filling an orientated container with product through the filling inlet as the orientated container is advanced by said first conveyor means, a sealing station for collapsing the filling inlet and completing the seal of the filled container, and means for discharging the filled sealed container from said first conveyor means.

13. Apparatus as claimed in claim 12, wherein said sealing station ultrasonically welds said container halves to one another.

14. Apparatus as claimed in claim 12, wherein said first conveyor means intermittently advances the forming material and formed container through the various stations for carrying out the operations as the first conveyor means is stationary.

15. Apparatus as claimed in claim 14, wherein the apparatus is a multilane apparatus for completing the same operations in each lane of the apparatus.

16. Apparatus as claimed in claim 15, wherein said first conveyor means includes conveyor plates which are rotatable for orientating the containers for filling.

17. Apparatus as claimed in claim 16, adapted to produce two containers with each movement of the first conveyor means.

18. Apparatus as claimed in claim 17, wherein said conveyor plates are adapted to engage about the periphery of the series of diecut material and retain a container when orientated for filling.

19. Apparatus as claimed in claim 18, wherein each conveyor plate has an under-cut region for providing a snap fit with the forming material.

20. Apparatus as claimed in claim 19, wherein said second conveyor means is driven in timed sequence with said first conveyor means.

* * * * *